United States Patent [19]

Callaham

[11] Patent Number: 4,726,592

[45] Date of Patent: Feb. 23, 1988

[54] AMUSEMENT DEVICE AND METHOD FOR USE

[76] Inventor: Bayliss O. Callaham, 13527 Charwell Crossing, Houston, Tex. 77069

[21] Appl. No.: 25,859

[22] Filed: Mar. 16, 1987

[51] Int. Cl.[4] ..... A63B 67/00

[52] U.S. Cl. ..... 273/342

[58] Field of Search ..... 273/342

[56] References Cited

U.S. PATENT DOCUMENTS

| | | | |
|---|---|---|---|
| 1,324,436 | 12/1919 | Cressman | 273/342 |
| 2,247,852 | 7/1941 | Saunders | 273/342 X |
| 3,837,648 | 9/1974 | Breslow | 273/342 |

FOREIGN PATENT DOCUMENTS

| | | | |
|---|---|---|---|
| 609364 | 5/1926 | France | 273/342 |
| 541398 | 11/1941 | United Kingdom | 273/342 |

*Primary Examiner*—William H. Grieb

*Attorney, Agent, or Firm*—Robert M. Carwell

[57] ABSTRACT

A novel amusement apparatus and method of use includes a container/play board, a plurality of hollow cylinder means of varying internal diameters and heights, and a plurality of balls of varying resiliency. The container/play board has leaf members hingedly interconnected to a base plate whereby in a first position such members are disposed in a horizontal playing configuration to provide upper rebound surfaces and in a second position the board forms a box-shaped container means for storing the components of the apparatus therewithin. In use, players position various of the cylinder members sequentially on the base plate and the balls are sequentially dropped onto the rebound surfaces in attempts to form a ball trajectory to the surface and then into the cylinder member.

11 Claims, 3 Drawing Figures

AMUSEMENT DEVICE AND METHOD FOR USE

FIELD OF THE INVENTION

This invention relates to amusement devices and, more particularly, relates to such apparatus conventionally intended for parlor use or the like which employ rebounding balls and providing target areas for receiving same.

BACKGROUND OF THE INVENTION

Games suitable for playing in a parlor-type environment or the like have long existed in the art for providing amusement to one or more players of the type wherein the primary feature of the game was a test of mental agility or recall. Whilst numerous such games have been devised, as a source of amusement and diversion, they often can tend to defeat the purpose of providing a source of relaxation.

Moreover, the strong appeal of testing one's manual dexterity and hand-eye co-ordination accordingly led to the devising of various other gaming devices which sought to test such skills of the player or players. A familiar example of this is the bean bag toss wherein a player seeks to toss a bean bag into an aperture or apertures of varying size in a backstop board.

Several deceptively simple-appearing problems and tradeoffs are associated with devising such a game. First, for maximum utility, the game must provide a great deal of variety in operation and skills being tested in order to avoid boredom. In this respect, the aforementioned bean bag game suffers greatly. Secondly, for optimum utility, such a game would desirably appeal to adults as well as children, and thus require variety as well as a wide range of physical skills necessary to play. Again, in this respect, such amusement devices as bean bag, ball, ring tosses or the like fall far short of this objective.

Yet a further constraint on the particular game design is that, for versatility, it should ideally be adapted for use both individually and by groups of players. In the latter case, it is further desirable for such a game to be played by a plurality of players individually in sequence, as for example in a party setting wherein the other enjoyable aspects of the party may be experienced by the players while awaiting their turns and wherein the possibilities of team play exist as well as individual play amongst the group. Still a further problem with devising a satisfying game design is that, particularly for parlor-type applications, it must be relatively compact for storage and portability and fashioned in such a manner that it is self-contained.

These and other shortcomings associated with prior art game designs are overcome by the instant invention wherein an amusement device and method of use requiring physical participation are provided affording great variety in terms of skills, age levels and tasks necessary to play, interest generated over such wide age and physical ability ranges, adaptation to solo or group play, and convenience of storage.

These and other advantages and objects of the invention may be more clearly understood with reference to the accompanying drawings and detailed description, wherein:

SUMMARY OF THE INVENTION

Figure 1:
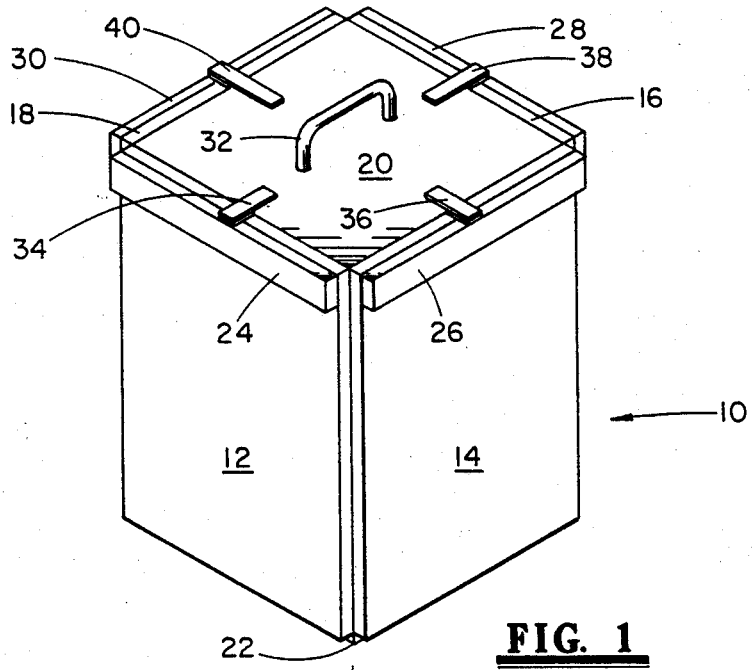
FIG. 1 is an isometric illustration of the container/-game board of the present invention when folded into the storage mode.

In a preferred embodiment, the amusement device of the present invention includes a main container/playing board body member (providing the combined function of a convenient portable storage cabinet for the various components of the game as well as providing a plurality of playing surfaces to be hereinafter described in greater detail), a plurality of hollow cylindrical members, preferably of differing diameters and heights whereby they may nest in coaxial alignment during storage, and a plurality of balls of differing resiliency.

The main container/playing board body member is comprised of a base plate means defining a plurality of edges and a plurality of side leaf members. Each leaf member is hingedly interconnected at one respective end thereof to a different one of the edges of the base plate means. At the outermost end surface of each leaf member an elevating means is disposed. Each side leaf member defines an upper playing surface having disposed thereupon intermediate each end of the particular leaf a target indicator, preferably each corresponding to a different one of the aforesaid cylindrical members.

In operation, with each leaf member pivotally lowered about its respective hinge into a generally horizontal position co-planar with the upper surface of the base plate means, due to the elevating members these upper playing surfaces of the respective leaf members will be inclined slightly with respect to the horizontal upper surface of the base plate means so as to face slightly inwards in the general direction of a vertical axis of symmetry of the base plate means and to define respective anles. In a preferred embodiment, these angles will preferably be obtuse and about 170 degrees or the like.

When the amusement device of the present invention is not in use, the leaf members may be rotated about their respective hinge means into generally vertical positions. In a preferred embodiment, four such leaf members are provided whereby when disposed in a generally horizontal position, as aforesaid, the upper playing surfaces thereof in conjunction with the upper surface of the bottom plate means define, in a top plan view, a generally cross-shaped configuration. However, when the leaf members are rotated to their vertical positions, a rectangular volume is therby defined by the leaf members and base plate means in which the cylinder members nested together as previously describe may be disposed together with the balls. A top cover may further be provided of a generally square configuration having fastener means disposed at each edge thereof intended to releasably engage corresponding fastener members adjacent the ends of the leaf members opposing the hinged ends when disposed in the vertical position, thereby serving to enclose the rectangular space. A handle may be provided on the upper cover for convenience in carrying and storing the apparatus when thus assembled into the storage mode.

In operation, one of the cylindrical members is preselected from the plurality thereof and disposed on the upper surface of the base plate. In a preferred embodiment, each such cylinder member will correspond to a different one of the target indicators on the upper surface of a different one of the leaf members. When disposed on the base plate, each cylinder will leave an upper circularly shaped aperture on one end thereof open for receiving sequentially each of the balls which is placed into play at the proper trajectory by the player, who seeks to rebound the ball off the upper playing surfaces into the cylinder members.

During play, a particular player will be positioned slightly radially outwards of the leaf member corresponding to the selected cylinder. In one embodiment, correspondence between a given leaf member and cylinder may be effected by means of color coding of each cylinder member to a different one of the target indicators on each different leaf member. Once the player has thus been positioned, he or she then sequentially drops each of the balls onto the upper playing surface of the leaf member in the general area of its target indicator. Due to the slight incline of these surfaces toward to cylinder, the ball will rebound in a general direction toward the cylinder. The player records the number of such balls which follow a successful trajectory into the cylinder after rebounding from the playing surface, adjusting the heighth and position of drop according to each ball and cylinder characteristic to achieve a successful trajectory result.

When all such balls have thus been dropped, the cylinder is replaced with a next cylinder. The player then similarly is positioned outwards of the next leaf member corresponding to that cylinder and the balls again sequentially dropped, with the player seeking to drop them in such a manner that they will, after rebounding from the playing surface of that leaf member, again follow a successful trajectory into the cylinder. This process is repeated until all such cylinders and leaf members have been employed and the player's score tallied. In group play, each player may take his or her turn at the same leaf member with all the balls before the next cylinder is employed, or, alternatively, may perform an entire sequence using all leaf members and cylinders before the next player's turn to do likewise, as desired.

DETAILED DESCRIPTION OF THE PREFERRED EMBODIMENT

Referring first to FIG. 1, there may be seen depicted therein generally the amusement apparatus 10 of the present invention in a second closed configuration for storage and transportation wherein it takes a generally box-shaped form. A plurality of four side leaf members 12–18 are provided, a bottom base plate 22, and top cover plate 20 which may have conveniently attached thereto a conventional handle 32 for carrying.

Attached to the upper outer surfaces of each leaf member is a corresponding elevating member 24–30 whose purpose will become apparent shortly. Fastener means 34–40 are provided for releasably affixing the top cover plate 20 to the leaf members so as to hold the device 10 in the box-shaped configuration depicted in FIG. 1 when the device is not in use. These fastener means may take the form of side leaf fastener strips 44 (FIG. 2) for mating engagement with top cover plate fastener strips 46 (FIG. 2), both such sets of strips being fashioned of Velcro or the like.

Figure 2:
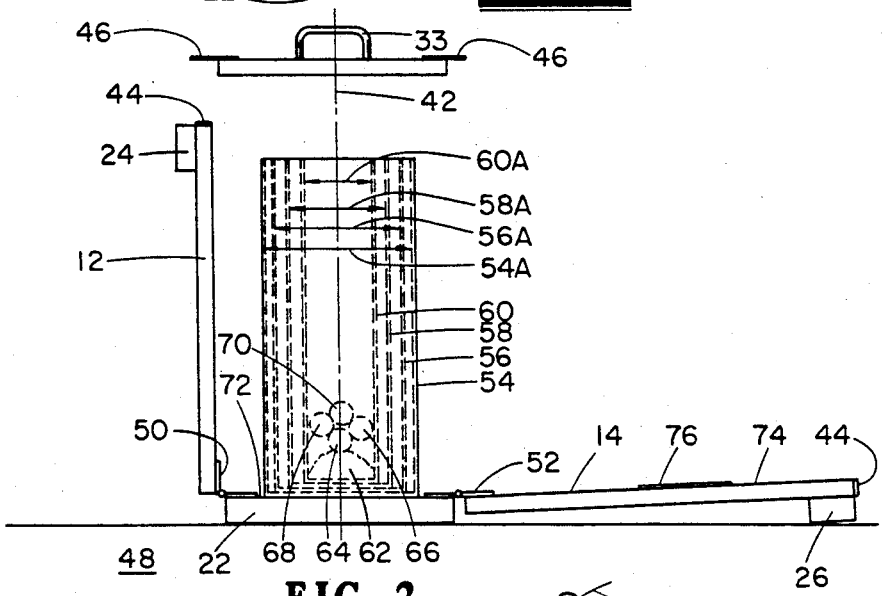
FIG. 2 is a side elevational view of the present invention depicting the various components thereof.

Referring now to FIG. 2, the device 10 is shown opened into a first or playing configuration mode wherein additional components of the game may further be seen. These include a plurality of hollow cylinder means 54–60 and a plurality of balls 64–70, as well as a dampering means 62.

With respect to the cylinder means 54–60, they are preferably of differing respective internal diameters 54A–60A and may also desirably be of differing heights, and are designed so that they may nest in coaxial alignment about the vertical axis of symmetry 42 of the base plate 22 when stored within the box shape of the device when in the second or storage mode.

Still referring to FIG. 2 in greater detail, it will be observed that each of the leaf members 12–18 is pivotally interconnected to a respective edge of the base plate 22 by any convenient means such as hinge means 50 and 52, only two of which are depicted in FIG. 2 for clarity. When the leaf members are folded down into the first or playing configuration mode whereby the device 10 is supported by a horizontal support surface 48, an upper surface 72 of the bottom base plate 22 is exposed, as well as corresponding upper playing or rebound surfaces 74 of the leaf members 12–18.

Each such playing surface will preferrably include a corresponding one of a plurality of target indicators 76–82 (FIG. 3) each disposed intermediate the opposing ends of the particular leaf member. Each such indicator will preferrably further uniquely correspond to a given one of the cylinder members, as, for example, by means of identically color coding each target indicator-cylinder pair.

Figure 3:
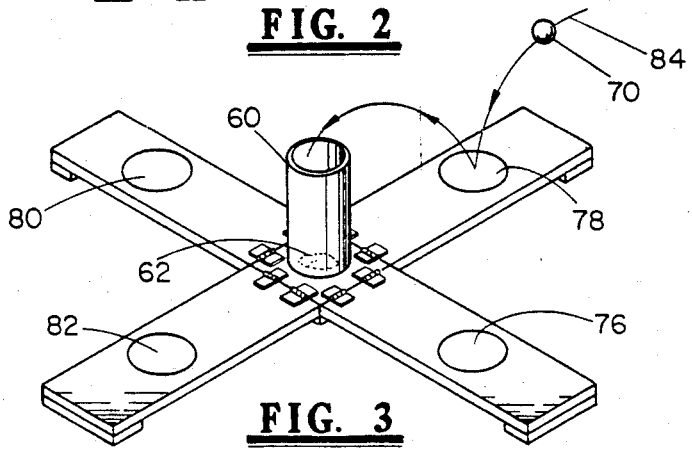
FIG. 3 is an isometric illustration of the present invention wherein the container/game board is in the operational playing mode.

With reference now to FIG. 3, the manner of playing the amusement device will now be described. Referring briefly back to FIG. 2, it will be noted that the elevating members 24–30 attached to the underneath sides of the leaf members 12–18 will cause the upper playing surfaces 74 thereof to be slightly inclined with respect to the horizontal upper surface 72 of the base plate 22 so as to preferably form an obtuse angle in combination of about 170 degrees or the like. In play, a player selects one of the cylinder members 54–60, placing it in the center of the base plate 22 in coaxial alignment with the vertical axis of symmetry 42 of the base plate.

The player thence positions himself or herself adjacent the radially outer end of the particular leaf member corresponding to this cylinder with reference to the aforesaid color coding or the like between the cylinders and their corresponding matching target indicators 76–82. The player thence places the dampering means 62, which may take the form of a small bag filled with a dampening material such as sand or the like within the cylinder and selects one of the balls 64–70. Each such ball is preferably of a differing characteristic in terms of resiliency, as for example, in providing a Ping Pong ball, hard and soft rubber ball, golf ball, and the like.

With continued reference to FIG. 3, the player thence elevates the ball to a desired position above the target indicator and drops the ball onto the playing or rebounding surface. The ball will, if positioned and dropped correctly in terms of height and place of impact on the playing surface, follow a successful trajectory such as that shown as reference numeral 84 whereupon, after impact with the rebound surface, it will come to rest within the cylinder member.

The player will continue in this manner sequentially with the other balls, adjusting the height at which they are dropped and point of impact in accordance with the particular ball's characteristics as well as those of the cylinder (which may vary not only in internal diameter but height as well) in an effort to deposit all balls within the cylinder. A record is keep of successful trajectories. When all balls have been used, a next cylinder is selected and the player positioned adjacent the next corresponding leaf member and the process is repeated. In use with multiple players, each player may take their turns at a given "station" or leaf member with a particular cylinder and all the balls before doing likewise at a next station. Alternatively, one player may be permitted to complete attempts at all such stations before, sequentially, next players are permitted to do so.

Several aspects of the hereindescribed invention require elaboration. First, the purpose of the dampering means 62 is to prevent the balls, when on a successful trajectory, from rebounding off the upper base plate surface, thereby easing their recovery. Next, whereas in a particularly convenient form of the game four leaf members and corresponding rebound surfaces as well as four cylinders and balls are depicted, the invention is not intended to be so limited. It will thus be appreciated that in an alternate embodiment, for example, more or fewer leaf members may be provided, in which case when the device is in the second storage mode depicted in FIG. 1, it will not assume the form depicted therein of a generally rectangularly shaped box but rather some other preferrably regular three dimensional polygonal form. Still further, the selection of the characteristics of the cylinders and balls may be varied as desired to provide the desired degree of difficulty and variability to the game, as, for example, in providing balls of more similar resiliency, cylinders of like heighth or extreme ranges of internal diameters or even vary narrow such diameters, or the like. Still further, it may be desirable to provide elevating members 24–30 which are different in height so as to provide varying angles of inclination of each playing surface for increased degree of difficulty.

It is therefore apparent that the present invention is one well adapted to obtain all of the advantages and features hereinabove set forth, together with other advantages which will become obvious and apparent from a description of the apparatus itself. It will be understood that certain combinations and subcombinations are of utility and may be employed without reference to other features and subcombinations. Moreover, the foregoing disclosure and description of the invention is only illustrative and explanatory thereof, and the invention admits of various changes in the size, shape, and material composition of its components, as well as in the details of the illustrated construction, without departing fom the scope and spirit thereof.

What is claimed is:

1. A method of playing an amusement device having a plurality of hollow cylinder members each with a different internal diameter, a plurality of balls, each with a differing resiliency, a base plate for supporting uprightly each of said cylindrical members defining a vertical axis, a plurality of upper playing surfaces each extending radially away from said base plate in a different direction, each said surface carrying a target indicator and being inclined toward said vertical axis and corresponding to a different one of said cylinder members, said method comprising:

a. disposing a selected one of said cylindrical members on said base plate in vertical coaxial alignment with said axis;

b. sequentially selecting different ones of said plurality of balls;

c. sequentially disposing each of said selected balls above one of said target indicators corresponding to said selected cylindrical member;

d. sequentially dropping said each sequentially selected ball onto said one of said target indicators whereby a trajectory path is defined;

e. recording for each said dropped ball whether said trajectory path terminates within said selected cylindrical member;

f. disposing a next selected one of said cylindrical members on said base plate in said vertical coaxial alignment with said axis;

g. sequentially selecting different ones of said plurality of balls;

h. sequentially disposing said each of said selected balls above a next different one of said selected target indicators corresponding to said next selected one of said cylindrical members;

i. sequentially dropping said each sequentially selected ball onto a selected said next different one of said selected target indicators whereby a trajectory path is defined;

j. recording for each said dropped ball whether said trajectory path terminated within said next selected one of said cylindrical members; and k. repeating steps f. through j. for each said cylindrical member.

2. An amusement device, comprising:

at least one hollow cylindrical member;

a base plate means for supporting said at least one cylinder member in a vertical position and centrally thereof defining a plurality of edges and having first fastener means disposed adjacent each outer edge thereof and further defining an upper base plate surface;

a top plate means;

a plurality of side leaf members each having an upper playing rebound surface, each said leaf further having a second fastener means disposed at the outer end thereof, each said side leaf member being hingedly interconnected at one respective end thereof to a different one of said edges whereby when said base plate means and said plurality of leaf members are disposed in an open second playing configuration mode on a support surface upper playing surfaces thereof lie substantially in a horizontal plane and define, in combination, a cross-shaped configuration; and when said leaf members are rotated about said hinged interconnections with said base plate means to a substantially vertical closed first storage configuration mode with said second fastener means interconnected to respective ones of said first fastener means to retainedly hold said top plate means to said side leaf members, said leaf members, said top plate means, and said base plate means define, in combination, a hollow rectangular closed box-shaped container adapted to receive said at least one cylindrical member and said at least one ball therewith.

3. The apparatus of claim 2 further including:

a plurality of elevating means each disposed at a different respective one of said outer ends of said side leaf members for elevating said outer ends of said side leaf members whereby said upper playing surfaces of said leaf members are inclined with respect to said upper base plate surface to define obtuse inclination angles.

4. The apparatus of claim 3 wherein:

said base plate means defines a central vertical axis normal to said upper base plate surface;

each said side leaf means defines a respective central side leaft axis normal to each respective said upper laying surface; and wherein said central vertical axis is intersected by said side leaf axes at a point along said vertical axis.

5. The apparatus of claim 3 wherein said upper playing surfaces are substantially flat.

6. The apparatus of claim 5 wherein:

said side leaf members each include a target indicator disposed intermediate a respective said outer end of said leaf member and hinged interconnected to said lower base plate means.

7. The apparatus of claim 6 wherein:

each said at least one cylinder member defines a respective internal diameter, and height;

wherein each said at least one ball has a resilience; and wherein said inclination angles, said resilience, and said internal diameters are preselected in functional relation whereby when each said at least one ball is dropped from a vertical location above said leaf members onto corresponding ones of said target indicators, said each ball will defined a trajectory path from said location to said indicator to a location within said at least one cylinder member.

8. The apparatus of claim 7 wherein:

each said cylinder member has a different one of said internal diameters.

9. The apparatus of claim 8 wherein each said elevating means has a different vertical height to define a corresponding one of said elevating angles of differing magnitude than remaining ones of said angles.

10. The apparatus of claim 7 wherein each said cylinder member height is different.

11. The apparatus of claim 8 wherein each said cylinder member includes an indicator corresponding to a different one of said targets.

* * * * *